US007935663B2

(12) United States Patent
Chase et al.

(10) Patent No.: US 7,935,663 B2
(45) **Date of Patent: *May 3, 2011**

(54) MOLYBDENUM COMPOUNDS

(75) Inventors: Kevin J. Chase, Branford, CT (US); John M. DeMassa, Trumbull, CT (US); Brian W. Stunkel, Stamford, CT (US); Glenn A. Mazzamaro, Ridgefield, CT (US)

(73) Assignee: R. T. Vanderbilt Company, Inc., Norwalk, CT (US)

( * ) Notice: Subject to any disclaimer, the term of this patent is extended or adjusted under 35 U.S.C. 154(b) by 401 days.

This patent is subject to a terminal disclaimer.

(21) Appl. No.: 12/041,130

(22) Filed: Mar. 3, 2008

(65) Prior Publication Data

US 2008/0220999 A1 Sep. 11, 2008

Related U.S. Application Data

(60) Provisional application No. 60/893,195, filed on Mar. 6, 2007, provisional application No. 60/944,897, filed on Jun. 19, 2007.

(51) Int. Cl.
*C10M 159/18* (2006.01)

(52) U.S. Cl. ..... 508/230; 508/244; 508/262; 508/362; 508/385; 508/543

(58) Field of Classification Search ..... 508/230, 508/244, 262, 263, 362, 363, 385, 543
See application file for complete search history.

(56) References Cited

U.S. PATENT DOCUMENTS

| | | | | |
|---|---|---|---|---|
| 4,122,033 | A | 10/1978 | Black | |
| 4,164,473 | A * | 8/1979 | Coupland et al. | 508/362 |
| 4,217,292 | A | 8/1980 | Kroenke | |
| 4,259,254 | A | 3/1981 | Bridger | |
| 4,261,843 | A | 4/1981 | King | |
| 4,705,641 | A | 11/1987 | Goldblatt | |
| 4,889,647 | A * | 12/1989 | Rowan et al. | 508/367 |
| 5,073,278 | A | 12/1991 | Schumacher | |
| 5,198,130 | A | 3/1993 | Schumacher | |
| 5,204,473 | A | 4/1993 | Winter et al. | |
| 5,268,113 | A | 12/1993 | Evans | |
| 5,273,669 | A | 12/1993 | Schumacher | |
| 5,994,277 | A | 11/1999 | Ritchie | |
| 6,103,674 | A | 8/2000 | Nalesnik et al. | |
| 6,306,802 | B1 | 10/2001 | Shaub | |
| RE38,929 | E * | 1/2006 | Gatto et al. | 508/364 |
| 7,875,579 | B2 * | 1/2011 | Chase et al. | 508/364 |
| 2003/0134754 | A1 | 7/2003 | Kelley | |
| 2004/0152910 | A1 | 8/2004 | Fukuoka et al. | |
| 2006/0035791 | A1 | 2/2006 | Donnelly et al. | |
| 2006/0276351 | A1 | 12/2006 | Mucha et al. | |
| 2008/0051306 | A1 | 2/2008 | Chasan et al. | |

* cited by examiner

*Primary Examiner* — Glenn A Caldarola
*Assistant Examiner* — Taiwo Oladapo
(74) *Attorney, Agent, or Firm* — Norris McLaughlin & Marcus, P.A.

(57) ABSTRACT

Novel molybdenum compounds are prepared by reacting a hindered amine with a molybdenum source, in the presence of one of (a) water, (b) a diol and water, and (c) the reaction product of a fatty oil and a multifunctional amine, and water. Lubricant compositions containing these new compounds are more stabilized against oxidation and have improved friction reducing properties. Synergy is observed when the novel compounds are combined with a diaryl amine in a lubricant composition.

10 Claims, No Drawings

MOLYBDENUM COMPOUNDS

This application is a non-provisional application claiming benefit under 35 U.S.C. 119(e) of U.S. Ser. Nos. 60/893,195 filed Mar. 6, 2007 and 60/944,897 filed Jun. 19, 2007.

BACKGROUND OF THE INVENTION

1. Field of the Invention

This invention relates to the preparation of novel metal compounds, particularly molybdenum compounds, based on a reaction of a metal source with hindered amines, and their incorporation into lubricant compositions containing a hindered amine and/or an aromatic amine.

2. Description of the Related Art

Oxidation is a major cause of the breakdown of lubricants. This results in a shortened lifespan of the lubricant, requiring more frequent changes, especially in demanding environments such as internal combustion engines.

Antioxidants have therefore played an important role as additives in lubricants in order to extend their useful life. Aromatic amines, especially secondary diarylamines, e.g., alkylated diphenylamines, phenothiazines, and alkylated N-naphthyl-N-phenylamines have been important additives to lubricating compositions. Also important have been phenolic compounds in retarding oxidation.

Other antioxidants have also been used. U.S. Pat. Nos. 5,073,278 and 5,273,669 to Schumacher et al. disclose the use of hindered amines in a lubricating oil. U.S. Pat. No. 5,268,113 to Evans et al. discloses the synergistic combination of a hindered amine with phenolic compounds.

Oil-soluble molydenum compounds are also known to provide antioxidant capabilities in lubricant compositions. U.S. Pat. No. 4,122,033 to Black discloses an oxidation inhibitor for lubricating oils that one or more transition metal containing compounds can be utilized in as oxidation inhibitors in lubricating compositions. Among the transition metal compounds useful are the salts of scandium, titanium, vanadium, chromium, manganese, iron, cobalt, nickel, copper, yttrium, zirconium, niobium, molybdenum, tellurium, ruthenium, rhodium, palladium, and silver. It was also found in U.S. Pat. No. 4,705,641 to Goldblatt et al., that the combination of copper and molybdenum salts were effective as antioxidants in lubricant compositions. However, in both patents antioxidant activity was only found under certain conditions.

The combination of an antioxidant with a metal compound has been important in the extending the lifetime of the antioxidant. For example, U.S. Pat. No. 5,994,277 to Richie et al. teaches that a crankcase lubricant composition which contains copper, molybdenum and aromatic amines can act as an effective antioxidant combination. U.S. Pat. No. 6,306,802 to Shaub et al. discloses sulfurized molybdenum complexes with oil-soluble aromatic amines. Gatto, et al., in U.S. Pat. No. RE38,929E has disclosed the combination of certain sulfur and phosphorus-free molybdenum compounds and secondary diarylamines improved the useful life of a lubricating oil. The most effective amounts in inhibiting oxidation were between 100 and 450 parts per million (ppm) of molybdenum, and between 750 and 5,000 ppm of an oil-soluble secondary diphenylamine.

Oil-soluble molybdenum compounds are also known to provide antifriction properties to a lubricant composition. Friction is of particular significance in internal combustion engines, because loss of substantial amount of theoretical mileage is traceable directly to friction. Friction will increase the power required to effect movement, thus increasing fuel consumption. Therefore, it is advantageous to use lubricants which minimize this friction.

Since various antifriction additives act in a different physical or chemical manner, only some satisfy the effectiveness and compatibility criteria leading to a significant energy loss prevention function of the lubricant. Types of molybdenum compounds known to be useful in engine lubricants include certain dithiocarbamate derivatives of molybdenum disclosed in U.S. Pat. No. 4,259,254. The use of molybdenum complexes of fatty alkyl amines in conjunction with a sulfur donor is taught in U.S. Pat. No. 4,164,473.

It has been surprisingly discovered that novel oil-soluble molybdenum compounds prepared from hindered amines impart unusually strong antioxidant and excellent antifriction properties to lubricants, potentially resulting in longer lubricant lifetime, and improved fuel economy. The antioxidant activity far exceeds other molybdenum complexes under the same testing conditions. We have also discovered that lubricant compositions containing the novel molybdenum compounds either alone, or in combination with a hindered amine and/or a secondary diarylamine can give enhanced antioxidant protection to that lubricant.

SUMMARY OF THE INVENTION

The present invention provides for the preparation of novel molybdenum compounds from hindered amines, a molybdenum source, and either water, a diol compound or the reaction product of a fatty oil and multifunctional amine. We have found these compounds to exhibit excellent antioxidant properties in a lubricant composition. The present invention also provides a process for preparing novel molybdenum compounds; a lubricating composition containing the novel molybdenum compounds, as well as lubricating compositions containing a synergistic combination of the novel molybdenum compounds with hindered amines and/or diarylamines as antioxidants

DETAILED DESCRIPTION OF THE INVENTION

The invention provides a novel composition of matter which comprises the reaction product of a hindered amine and a metal source. For all of the novel compounds disclosed herein, the metal source is preferably a molybdenum or tungsten source, and most preferably a molybdenum source. It is understood that tungsten and other metals, such as manganese, chromium, titanium, niobium, vanadium, zirconium, iron, cobalt, nickel, copper, zinc, and boron are expected to react in similar fashion.

In the case of molybdenum, it is fully expected that the reaction of a hindered amine, and a molybdenum source in an aqueous medium will produce a hindered ammonium molybdate. In U.S. Pat. No. 4,217,292 to Kroenke, a process for preparing amine molybdates is described where an amine and $MoO_3$ in an aqueous medium is reacted between room temperature and 110 degrees C. In U.S. Pat. No. 4,261,843 to King, et al., the reaction of an acidic molybdenum compound with a basic nitrogen compound yields molybdenum-containing materials suitable for lubricant additives.

The invention also provides a composition of matter which comprises the reaction product of a hindered amine, a molybdenum source, and a diol.

The invention also provides a composition of matter which comprises the reaction product of a hindered amine, a molybdenum source and the reaction product of a fatty oil and multifunctional amine. A multifunctional amine is defined here as an amine containing two or more amine or hydroxyl functional groups, and may be for example 1-(2-aminoethyl)-aminoethanol or isodecyloxypropyl-1,3-diaminopropane, and preferably diethanolamine.

The invention also provides a lubricant composition which comprises a lubricating oil basestock with a novel metal compound as described herein, the metal compound being present at a concentration between 1 and 2,000 parts per million, preferably about 50 ppm to 750 ppm, more preferably about 125 to 750 ppm, and most preferably about 700 ppm.

The invention also provides a lubricant composition which comprises a lubricating oil basestock with a novel metal compound as described herein, the metal compound being present at a concentration between 1 and 2,000 parts per million, preferably about 50 ppm to 750 ppm, more preferably about 125 to 750 ppm, most preferably about 700 ppm, and an aromatic amine providing between 0.001 and 2 wt %, preferably about 0.5-1.5 wt % aromatic amine in the lubricant composition.

In one embodiment, the novel molybdenum compounds prepared according to this invention are the reaction products of a hindered amine, a molybdenum source such as $MoO_3$, water, and a diol or the reaction of product of a fatty oil and a multifunctional amine. Assigning the molybdenum source as 1 mole, 0.5 to 3 moles of the hindered amine, preferably 1 to 2 moles are used, and between 1 to 3.5 moles of either the diol or the reaction product of a fatty oil and a multifunctional amine, preferably 2 moles are used. The reagents are added and heated to a temperature between 60 and 150° C. for a period of 1 to 6 hours. After the period of reaction, water is removed by distillation and vacuum stripping, revealing a yellow to red product. A specific chemical composition cannot be assigned to the new material, but from infrared spectroscopy is expected to contain a cis-dioxo Mo structure, indicative of a neutral, octahedral Mo(VI) complex.

Hindered Amine

The hindered amines used in this invention are of many types, with three types predominating, the pyrimidines, piperidines and stable nitroxide compounds. Many more are described in the book "Nitrones, Nitronates, and Nitroxides", E. Breuer, et al., 1989, John Wiley & Sons. The hindered amines are also known as HALS (hindered amine light stabilizers) and are a special type of amine that are capable of antioxidant behavior. They are used extensively in the plastics industry to retard photochemical degradation, but their use in lubricants has been limited.

1. Pyrimidine compounds

Pyrimidine compounds are of the substituted tetrahydro type and include the general structure of a 2,3,4,5 tetrahydropyrimidine as given below (I), and described by Volodarsky, et al. in U.S. Pat. No. 5,847,035, and by Alink in U.S. Pat. No. 4,085,104.

(I)

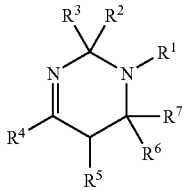

$R^1$ is H, O, or a hydrocarbon from 1 to 25 carbon atoms, or an alkoxy radical with the oxygen bound to the nitrogen with the alkyl portion containing 1 to 25 carbon atoms. $R^2$, $R^3$, $R^4$, $R^5$, $R^6$, and $R^7$ are hydrocarbons with 1 to 25 carbon atoms each. Most preferably, $R^2$, $R^3$, $R^6$, and $R^7$ are methyls.

Other pyrimidine compounds that can are of the hexahydro type, (II)

(II)

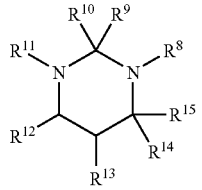

$R^8$ and $R^{11}$ are H, O, or a hydrocarbon from 1 to 25 carbon atoms, or an alkoxy radical with the oxygen bound to the nitrogen with the alkyl portion containing 1 to 25 carbon atoms. $R^9$, $R^{10}$, $R^{11}$, $R^{12}$, $R^{13}$ $R^{14}$, and $R^{15}$ are hydrocarbons with 1 to 25 carbon atoms each. Most preferably, $R^9$, $R^{10}$, $R^{14}$, and $R^{15}$ are methyls.

2. Piperidine compounds

The piperidine compounds used in this invention are described by Schumacher, et al., U.S. Pat. No. 5,073,278 and by Evans in U.S. Pat. No. 5,268,113. These compounds have the general formula (III);

(III)

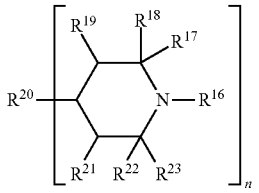

where $R^{16}$ is H, O or a hydrocarbon from 1 to 25 carbon atoms, an alkoxy radical with the oxygen bound to the nitrogen with the alkyl portion containing 1 to 25 carbon atoms, or a COR group, the R being a hydrocarbon containing from 1 to 25 carbon atoms, $R^{17}$, $R^{18}$, $R^{22}$, $R^{23}$ are hydrocarbons with 1 to 25 carbon atoms, $R^{19}$, $R^{21}$ are H or hydrocarbons with 1 to 25 carbon atoms. Most preferably $R^{17}$, $R^{18}$, $R^{22}$ and $R^{23}$ are methyls.

when n=1, $R^{20}$ is OH, H, O, $NH_2$, $NR_2$ where R is a hydrocarbon with 1 to 25 carbon atoms, an ester group $O_2CR$ where R is a hydrocarbon with 1 to 25 carbon atoms, or a succinimide group. When n=2, $R^{20}$ is the diacyl radical of an aliphatic dicarboxylic acid having 4 to 12 carbon atoms.

Examples of hindered amines based upon piperidine include 4-hydroxy-2,2,6,6-tetramethylpiperidine, 1-allyl-4-hydroxy-2,2,6,6-tetramethylpiperidine, 1-benzyl-4-hydroxy-2,2,6,6-tetramethylpiperidine, 1-(4-tert-butylbut-2-enyl)-4-hydroxy-2,2,6,6-tetramethylpiperidine, 4-stearoyloxy-2,2,6,6-tetramethylpiperidine, 1-ethyl-4-salicyloyloxy-2,2,6,6-tetramethylpiperidine, 4-methacryloyloxy-1,2,2,6,6-pentamethylpiperidine, 1,2,2,6,6-pentamethylpiperidin-4-yl.-(3,5-di-tert-butyl-4-hydroxyphenyl)propionate, di(1-benzyl-2,2,6,6-tetramethylpiperidin-4-yl)maleate, di(2,2,6,6-tetramethylpiperidin-4-yl)succinate, di(2,2,6,6-tetramethylpiperidin-4-yl)glutarate, di(2,2,6,6-tetramethylpiperidin-4-yl)adipate, di(2,2,6,6-tetramethylpiperidin-4-yl)sebacate, di(1,2,2,6,6-pentamethylpiperidin-4-yl)sebacate, di(1,2,3,6-tetramethyl-2,6-diethylpiperidin-4-yl)sebacate, di(1-allyl-2,2,6,6-tetramethylpiperidin-4-yl)phthalate, 1-hydroxy-4-.beta.-cyanoethoxy-2,2,6,6-tetramethylpiperidine, 1-acetyl-2,2,6,6-tetramethylpiperidin-4-yl acetate, tri(2,2,6,6-tetramethylpiperidin-4-yl)trimellitate, 1-acryloyl-4-benzyloxy-2,2,6,6-tetramethylpiperidine, di(2,2,6,6-tetramethylpiperidin-4-yl)diethylmalonate, di(1,2,2,6,6-pentamethylpiperidin-4-yl) dibutylmalonate, di(1,2,2,6,6-pentamethylpiperidin-4-yl)butyl(3,5-di-tert-butyl-4-hydroxybenzyl)malonate, di(1-octyloxy-2,2,6,6-tetramethylpiperidin-4-yl)sebacate, di(1-cyclohexyloxy-2,2,6,6-tetramethylpiperidin-4-yl)sebacate, hexane-1',6'-bis(4-carbamoyloxy-1-n-butyl-2,2,6,6-tetramethylpiperidine), toluene-2',4'-bis (4-carbamoyloxy-1-n-propyl-2,2,6,6-tetramethylpiperidine), dimethyl-bis(2,2,6,6-tetramethylpiperidin-4-oxy)silane, phenyl-tris(2,2,6,6-tetramethylpiperidin-4-oxy)silane, tris(1-propyl-2,2,6,6-tetramethylpiperidin-4-yl)phosphate, tris(1-propyl-2,2,6,6-tetramethylpiperidin-4-yl)phosphate, phenyl[bis (1,2,2,6,6-pentamethylpiperidin-4-yl)]phosphonate, 4-hydroxy-1,2,2,6,6-pentamethylpiperidine, 4-hydroxy-N-hydroxyethyl-2,2,6,6-tetramethylpiperidine, 4-hydroxy-N-(2-hydroxypropyl)-2,2,6,6-tetramethylpiperidine, 1-glycidyl-4-hydroxy-2,2,6,6-tetramethylpiperidine, dodecyl-N-(2,2,6,6,-tetramethyl-4-piperidinyl)succinate.

Most useful in this invention are the 2,2,6,6-tetramethylpiperidines, 1,2,2,6,6-pentaalkylpiperidines, 1-oxo-2,2,6,6-tetramethylpiperidines, and 1-alkoxy-2,2,6,6-tetramethylpiperidines.

3. Polymers Containing Hindered Amines

Polymeric 2,2,6,6-tetraalkylpiperidines and 1,2,2,6,6-pentaalkylpiperidines are also prevalent and may be used in this formulation. The polymeric compounds used in this invention are described by Schumacher, et al., U.S. Pat. No. 5,073,278, by Evans et al. in U.S. Pat. No. 5,268,113, and by Kazmierzak et al. in U.S. Pat. No. 4,857,595. There are several kinds of polymeric piperidine compounds available. Commercially available examples include Tinuvin® 622 from Ciba and Songlight® 9440 from Songwon.

4. Other Hindered Amines

Another type of hindered amine has been disclosed in U.S. Pat. No. 5,098,944 and describes hindered amines of the type shown in general formula (IV).

(IV)

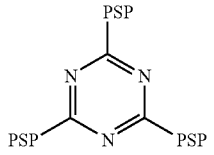

Wherein PSP represents a substituent derived from a cyclic amine represented by a structure selected from the group in general formulae (V)

(V)

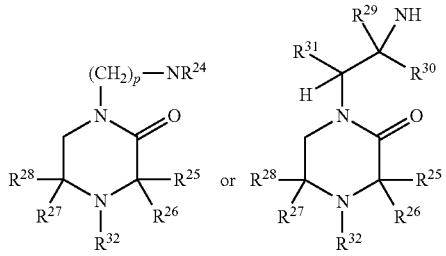

wherein PSP represents a substituent derived from a cyclic amine represented by a structure selected from the group consisting of wherein $R^{24}$ represents $C_1$-$C_{24}$ alkyl, $C_5$-$C_{20}$ cycloalkyl $C_7$-$C_{20}$ aralkyl or alkaryl, $C_1$-$C_{24}$ aminoalkyl, or $C_6$-$C_{20}$ aminocycloalkyl; $R^{25}$, $R^{26}$, $R^{27}$, and $R^{28}$ independently represent $C_1$-$C_{24}$ alkyl; and $R^{25}$ with $R^{26}$, or $R^{27}$ with $R^{28}$ are cyclizable to $C_5$-$C_{12}$ cycloalkyl including the $C_3$ and $C_5$ atoms respectively, of the piperazin-2-one ring; $R^{29}$ and $R^{30}$ independently represent $C_1$-$C_{24}$ alkyl, and polymethylene having from 4 to 7 carbonatoms which are cyclizable; $R^{31}$ represents H, $C_1$-$C_6$ alkyl, and phenyl; $R^{32}$ represents $C_1$-$C_{25}$ alkyl, H, or O, or alkoxy with a hydrocarbon chain between 1 and 25 carbon atoms; and, p represents an integer in the range from 2 to about 10.

Molybdenum Source

Examples of molybdenum sources that can be used in this invention include a metal salt of molybdic acid, ammonium molybdate, or molybdenum trioxide.

Diols

The diols useful in this invention have the generalized structure (VI), (VI)

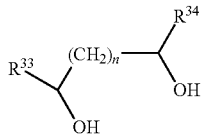

n = 0 to 12 where $R^{33}$ and $R^{34}$ is hydrogen or a hydrocarbon with between 1 and 25 carbon atoms. Examples of diols, including glycols, that can be used in this invention include fatty vicinal diols such as those available from Ashland Oil under the general trade designation Adol 114 and Adol 158. The former is derived from a straight chain alpha olefin fraction of $C_{11}$-$C_{14}$, and the latter is derived from a $C_{15}$-$C_{18}$ fraction. Preferred diols are 2-ethyl-1,3-hexanediol and 1,2-dodecanediol.

Fatty Oils

Fatty oils that can be used in this invention include; coconut oil, rapeseed oil, palm kernel oil, corn oil, tall oil, or any triglyceride oil. These oils are then reacted with 1 to 3 equivalents of a multifunctional amine having the generalized structure (VII):

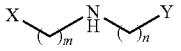

(VII)

Where m=a hydrocarbon radical with 1 to 10 carbon atoms, n=a hydrocarbon radical with 1 to 10 carbon atoms, X=OH, $NH_2$, or a hydrocarbon with 1 to 10 carbon atoms, Y=OH or $NH_2$.

Lubricant Basestocks

Typical lubricant basestocks can include both mineral and synthetic oils. Included are polyalphaolefins, (also known as PAOS), esters, diesters and polyol esters or mixtures thereof. The lubricant basestock is present in a lubricating composition as a major portion, i.e. at least 50 wt %.

Hindered Amines

Hindered amines can also be used as synergists in this invention. The hindered amines used are of many types, with two types predominating, the pyrimidines and piperidines. These are all described in great detail above, in U.S. Pat. No. 5,073,278, U.S. Pat. No. 5,273,669, and U.S. Pat. No. 5,268,113. Preferred hindered amines include 4-stearoyloxy-2,2,6,6-tetramethylpiperidine and dodecyl-N-(2,2,6,6,-tetramethyl-4-piperidinyl)succinate, sold under the trade names Cyasorb® UV-3853 and Cyasorb® UV-3581 respectively, from Cytec, di(2,2,6,6-tetramethylpiperidin-4-yl)sebacate and di(1,2,2,6,6-pentamethylpiperidin-4-yl)sebacate, sold as Songlight® 7700 and Songlight® 2920LQ respectively, from Songwon, and bis(1-octyloxy-2,2,6,-tetramethyl-4-piperidyl)sebacate, sold as Tinuvin® 123 by Ciba.

Diarylamines

The diarylamines used in this invention are of the type $Ar_2NR$. (VIII) Since these are well known antioxidants in the art, there is no restriction on the type of diarylamines used in this invention, although there is the requirement of solubility in the lubricating composition.

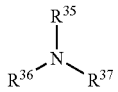

(VIII)

The alkylated diphenylamines are well known antioxidants and there is no particular restriction on the type of secondary diarylamine used in the invention. Preferably, the secondary diarylamine antioxidant has the general formula (X) where $R^{35}$ and $R^{36}$ each independently represents a substituted or unsubstituted aryl group having from 6 to 30 carbon atoms. $R^{37}$ represents either a H atom or an alkyl group containing from 1 to 30 carbon atoms. Illustrative of substituents for the aryl there can be mentioned aliphatic hydrocarbon groups such as alkyl having from about 1 to 20 carbon atoms, hydroxy, carboxyl or nitro, e.g., an alkaryl group having from 7 to 20 carbon atoms in the alkyl group. The aryl is preferably substituted or unsubstituted phenyl or naphthyl, particularly wherein one or both of the aryl groups are substituted with an alkyl such as one having from 4 to 18 carbon atoms. $R^{37}$ can be either H or alkyl from 1 to 30 carbon atoms. The alkylated diphenylamines used in this invention can be of a structure other than that shown in the above formula which shows but one nitrogen atom in the molecule. Thus, the alkylated diphenylamine can be of a different structure provided that at least one nitrogen has 2 aryl groups attached thereto, e.g., as in the case of various diamines having a secondary nitrogen atom as well as two aryls on one of the nitrogens. The alkylated diphenylamines used in this invention preferably have antioxidant properties in lubricating oils, even in the absence of the molybdenum compound.

Examples of some alkylated diphenylamines that may be used in this invention include: diphenyl amine, 3-hydroxydiphenylamine; N-phenyl-1,2-phenylened-amine; N-phenyl-1,4-phenylenediamine; dibutyldiphenylamine; dioctyldiphenylamine; dinonyldiphenylamine; phenyl-alpha-naphthylamine; phenyl-beta-naphthylamine; diheptyldiphenylamine; and p-oriented styrenated diphenylamine.

Phenothiazines

Phenothiazines are another class of diarylamines with the general structure (IX),

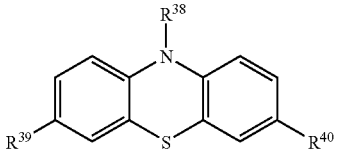

(IX)

Where $R^{38}$ is H, or an alkyl from 1 to 30 carbon atoms, and $R^{39}$ and $R^{40}$ are alkyl from 1 to 30 carbon atoms Lubricating Oil Compositions The lubricating oil compositions of this invention can be prepared by adding the molybdenum or tungsten containing additive to a basestock with an aromatic (diaryl) amine. Combinations can contain a metal compound sufficient to provide 1 to 20,000 parts per million metal, preferably 50 ppm to 750 ppm, more preferably 125 to 750 ppm, and optionally 0.001 to 2 wt %, preferably about 0.5-1.5 wt % diaryl amine and/or hindered amine, calculated to the total composition.

Other Additives

In addition, other additives can be added to the lubricating compositions described above. These include the following components:

- Other antioxidants, including phenols, hindered phenols, hindered bisphenols, sulfurized phenols, sulfurized olefins, alkyl sulfides and disulfides, dialkyl dithiocarbamates, dithiocarbamate esters, such as VANLUBE® 7723 sold by the R. T. Vanderbilt Company, zinc dihydrocarbyl dithiosphosphates, zinc dithiocarbamates. A more complete list of useful phenols can be found in U.S. Pat. No. 5,073,278 to Schumacher et al.
- Antiwear additives, including zinc dihydrocarbyl dithiophosphates, tricresol phosphate, diaryl phosphate, sulfurized fats and sulfurized terpenes.
- Dispersants, including polymethacrylates, styrenemaleic ester copolymers, substituted succinamides, polyamine succinamides, polyhydroxy succinic esters, substituted Mannich bases, and substituted triazoles.
- Detergents, including neutral and overbased alkali and alkaline earth metal sulfonates, neutral and overbased alkali and alkine earth metal phenates, sulfuized phenates, overbased phosphonates, and thiophosphonates.
- Viscosity index improvers, including polyacrylates, polymethacrylates, vinylpyrrolidone/methacrylate copolymers, polyvinylpyrrolidones, polybutesne, olefin copolymers, styrene/acrylate copolymers.
- Pour point depressants, including polymethacrylate and alkylated naphthalene derivatives.

Example 1

Preparation of Mo Compound (KJC-555-163)

Into a 500 mL round-bottomed flask was placed 15.0 g of $MoO_3$, 15.0 g water, 100 g of a reaction product of coconut oil (1 part) and diethanolamine (2.7 parts), and 40 g of Tinuven®123, a Ciba product with the chemical name bis-(1-octyloxy-2,2,6,6-tetramethyl-4-piperidyl)sebacate. The mixture was stirred and heated to 80° C. for 3 hours. An aspirator vacuum was then placed on the flask and heated for a period of 2 hours with the loss of water. The reaction was cooled somewhat and filtered hot through Celite, revealing an oily, reddish product containing 5.8% molybdenum. IR: 932, 905 $cm^{-1}$.

Example 2

Preparation of Mo Compound (KJC-555-171)

Into a 500 mL round-bottomed flask was placed 15.0 g of $MoO_3$, 15.0 g water, 62.5 g of 2-ethyl-1,3-hexanediol, and 54.6 g of Cyasorb® UV-3853, a hindered amine with the name 4-piperidol-2,2,6,6-tetremethyl-RPW stearin (fatty acids mixture). The mixture was stirred at 80° C. for 1 hour, then heated under vacuum for 1 hour. 10.36 g of a mineral oil was added, and then the mixture was filtered through Celite to give an oily, pale reddish product containing 7.7% Mo. IR: 924, 877 $cm^{-1}$.

Example 3

Preparation of Mo Compound (KJC-555-176)

Into a 500 mL round-bottomed flask was placed 15.0 g of $MoO_3$, 15.0 g water, 90.5 g of of a reaction product of coconut oil (1 part) and diethanolamine (2.7 parts), and 54.6 g of Cyasorb® UV-3853. The mixture was heated at 80° C. for 1 hour, then heated under vacuum for 70 minutes. 15.0 g of a mineral oil was then added to give an oily reddish product containing 5.9% Mo. IR: 903, 877 $cm^{-1}$.

Example 4

Products of Examples 1, 2, and 3 as Antioxidants

Pressurized differential scanning calorimetry (PDSC) was performed according to ASTM Test Method D6186 on the products of Examples 1, 2 and 3, also called KJC-555-163, KJC-555-171, and KJC-555-176 respectively. These tests were performed on a lubricant composition comprising a polyalphaolefin oil, Durasyn® 166 from BP, and Infineum® C9268, a crankcase dispersant containing 1.2% Nitrogen from Infineum. The test is performed by blending and adding the ingredients into a DSC cell, heating the cell to 210° C., then pressurizing with 500 psi of oxygen. What is measured is the oxidation induction time (OIT), which is the time takes to observe an exothermic release of heat. The longer the OIT the greater the oxidative stability of the oil blend. The results are shown in Table 1 labeled as "minutes to induction".

For comparison purposes, MOLYVAN® 855 was used as a molybdenum source. MOLYVAN® 855 is a molybdate ester compound containing 8% Mo and manufactured by the R.T. Vanderbilt Co., Inc. of Norwalk, Conn. The molybdenum containing compounds KJC-555-163, KJC-555-171 and KJC-555-176 (Examples 1, 2 and 3) and MOLYVAN® 855 were added to the lubricating compositions to give approximately 700 ppm of molybdenum.

The results clearly show an improved oxidative stability for the reaction products of Examples 1, 2 and 3 over the MOLYVAN® 855 alone. The use of the hindered amine in the preparation of the Example 1, 2 and 3 molybdate esters formed in the reaction obviously improves the antioxidant capability of the blend.

TABLE I

PDSC Induction Times for Motor Oil Blends

| | Wt % Additive (ppm Mo) | | | |
|---|---|---|---|---|
| Molyvan ® 855 | 0.91 (700) | | | |
| (Example 1) KJC-555-163 | | 1.21 (700) | | |
| (Example 2) KJC-555-171 | | | 0.91 (700) | |
| (Example 3) KJC-555-176 | | | | 1.19 (700) |
| Infineum C9268 | 3.96 | 3.95 | 3.90 | 3.90 |
| Durasyn 166 | 95.13 | 94.84 | 95.19 | 94.91 |
| Minutes to induction | 1.2 | 15.5 | 27.4 | 20.4 |

Example 5

Lubricant Compositions Containing Hindered Amine and Molybdenum Compound

Lubricant compositions were prepared similarly to example 4, except utilizing the products of Examples 2 and 3 with the N-methyl hindered amine Songlight® 2920LQ, (chemically bis(1,2,2,6,6-pentamethyl-1-piperidinyl)sebacate) and the aforementioned Cyasorb UV-3853. The molybdenum containing compounds were added to the lubricating compositions to give 700 ppm of Mo. PDSC was performed on the compositions as in example 4 (ASTM D1686) and is noted in TABLE II.

The results clearly show a synergy between the molybdenum compound and the hindered amine utilized. The oxidation induction times were significantly increased when both the hindered amine and the molybdenum compound were present, than when separate.

TABLE II

PDSC Induction Times for Motor Oil Blends

| | Wt % Additive (ppm metal) | | | | | |
|---|---|---|---|---|---|---|
| (Ex. 2) KJC-555-171 | 0.91 (700) | | 0.91 (700) | | | |
| Songlight 2920LQ | | | | | 1.5 | 1.5 |
| Cyasorb UV-3853 | | 1.5 | 1.5 | | | |
| (Ex. 3) KJC-555-176 | | | | 1.19 (700) | | 1.19 (700) |
| Infineum C9268 | 3.90 | 3.90 | 3.90 | 3.90 | 3.9 | 3.9 |
| Durasyn 166 | 95.19 | 94.6 | 93.69 | 94.91 | 94.6 | 93.41 |
| Minutes to induction | 27.4 | 2.7 | 73.7 | 20.4 | 4.7 | 79.3 |

Example 6

Lubricant Compositions Containing Alkylated Diphenylamine and Molybdenum Compound Lubricant compositions containing the combination of alkylated diphenylamine, and the products of Examples 2 and 3 were prepared and PDSC (ASTM D1686) was performed as in Example 4. The molybdenum containing compounds were added to the lubricating compositions to give 700 ppm of Mo. The results are given in Table IV.

Clearly there is a strong synergism observed when the combination of the alkylated diphenylamine and the reaction products of Examples 2 or 3 is used.

TABLE III

PDSC Induction Times for Motor Oil Blends

| | Wt % Additive (ppm metal) | | | | |
|---|---|---|---|---|---|
| Vanlube SL | 1.5 | | 1.5 | 1.5 | |
| (Ex. 2) KJC-555-171 | | 0.91 (700) | 0.91 (700) | | |
| (Ex. 3) KJC-555-176 | | | | 1.19 (700) | 1.19 (700) |
| Infineum C9268 | 3.94 | 3.90 | 3.90 | 3.90 | 3.90 |
| Durasyn 166 | 94.56 | 95.19 | 93.69 | 93.41 | 94.91 |
| Minutes to induction | 5.2 | 27.4 | 58.9 | 64.3 | 20.4 |

Example 7

Lubricant Compositions Containing Hindered Amine, Alkylated Diphenylamine and Molybdenum Compound Lubricant compositions containing the combination of a hindered amine, alkylated diphenylamine, and the products of Examples 2 and 3 were prepared and PDSC (ASTM D1686) was performed as in Example 4. The molybdenum containing compounds were added to the lubricating compositions to give 700 ppm of Mo. The results are given in Table IV.

The induction times clearly show improvement when the three components are together as opposed to just two at the same concentrations.

Example 8

Antifriction Data of Products of Examples 2 and 3

The test procedure for frictional properties used in this example is derived from the Annual Book of ASTM Standards 2004 section 5 Petroleum Products, Lubricants, and Fossil Fuels volume 05.03 under ASTM method D 5707, "Measuring Friction and Wear Properties of Lubricating Grease using a High-Frequency, Linear-Oscillation (SRV) Test Machine". This test is described in this method under the summary of the test method as "This test method is performed on an SRV test machine using a test ball oscillated under constant load against a test disk." This testing was not modified from the original test description other than the time was reduced from 2 hours to one hour. In the "scope" of this procedure, it is stated that "this test method can also be used for determining a fluid lubricant's ability to protect against wear and coefficient of friction under similar test conditions."

Antifriction data was collected on the products of Examples 2 and 3 and compared against MOLYVAN® 855 a molybdate ester compound containing 8% Mo and sold by the R.T. Vanderbilt Co. Samples were placed in a Conoco motor oil formulated without antioxidants and containing 0.5% phosphorus to give a concentration of 700 ppm of Mo. The final friction coefficient after 1 hour is reported in the Table V below.

TABLE V

SRV ® Final Friction Coefficients for Molybdenum Compounds in Motor Oil

| | Wt. % Additive (ppm Mo) | | | |
|---|---|---|---|---|
| Product of Example 2 (KJC-555-171) | 0.91 (700) | | | |
| Product of Example 3 (KJC-555-176) | | 1.19 (700) | | |
| MOLYVAN 855 | | | 0.91 (700) | |
| Conoco Motor Oil | 99.09 | 98.81 | 99.09 | 100 |
| Final Friction Coefficient | 0.052 | 0.064 | 0.057 | 0.136 |

What is claimed is:

1. A novel molybdenum compound which is a reaction product of a hindered amine and a molybdenum source, and one of the following:

(a) the reaction product of a fatty oil with a diethanolamine and water; or (b) a diol and water, wherein the diol is of the following formula:

TABLE IV

PDSC Induction Times for Motor Oil Blends

| | Wt % Additive (ppm metal) | | | | | | | | |
|---|---|---|---|---|---|---|---|---|---|
| Vanlube SL | | 1.5 | | 0.75 | 1.5 | 0.75 | | | 0.75 |
| (Ex. 2) KJC-555-171 | 0.91 (700) | 0.91 (700) | | 0.91 (700) | | | | | |
| Songlight 2920LQ | | | | | | | | 1.5 | 0.75 |
| Cyasorb UV-3853 | | | 1.5 | 0.75 | | 0.75 | | | |
| (Ex. 3) KJC-555-176 | | | | | 1.19 (700) | | 1.19 (700) | 1.19 (700) | 1.19 (700) |
| Infineum C9268 | 3.90 | 3.90 | 3.9 | 3.90 | 3.90 | 3.90 | 3.90 | 3.9 | 3.9 |
| Durasyn 166 | 95.19 | 93.69 | 94.6 | 93.69 | 93.41 | 94.6 | 94.91 | 93.41 | 93.41 |
| Minutes to induction | 27.4 | 58.9 | 2.7 | 74.3 | 64.3 | 9.6 | 20.4 | 79.3 | 81.1 |

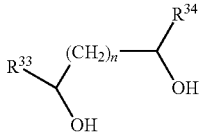

where n=0 to 12, and $R^{33}$ and $R^{34}$ is hydrogen or a hydrocarbon with between 1 and 25 carbon atoms, wherein the hindered amine is one or more chosen from the group consisting of:

(a) a compound of the formula

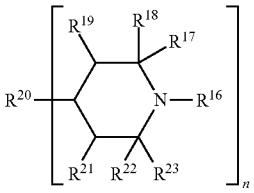

where $R^{16}$ is H, O or a hydrocarbon from 1 to 25 carbon atoms, an alkoxy radical with the oxygen bound to the nitrogen with the alkyl portion containing 1 to 25 carbon atoms, or a COR group, the R begin a hydrocarbon containing from 1 to 25 carbon atoms, $R^{17}$, $R^{18}$, $R^{22}$, $R^{23}$ are hydrocarbons with 1 to 25 carbon atoms, $R^{19}$, $R^{21}$ are H or hydrocarbons with 1 to 25 carbon atoms, when n=1, $R^{20}$ is OH, H, O, $NH_2$, $NR_2$ where R is a hydrocarbon with 1 to 25 carbon atoms, an ester group $O_2CR$ where R is a hydrocarbon with 1 to 25 carbon atoms, or a succinimide group, when n=2, $R^{20}$ is the diacyl radical of an aliphatic dicarboxylic acid having 4 to 12 carbon atoms (b) 4-stearoyloxy-2,2,6,6-tetramethylpiperidine, (c) di(2,2,6,6-tetramethylpiperidin-4-yl)sebacate, (d) di(1,2,2,6,6-pentamethylpiperidin-4-yl)sebacate, (e) bis(1-octyloxy-2,2,6,-tetramethyl-4-piperidyl)sebacate (f) polymer-bound piperidine compound, (g) a compound of the group consisting of 2,2,6,6-tetramethylpiperidines, 1,2,2,6,6-pentamethylpiperidines, 1-oxo-2,2,6,6-tetramethylpiperidines, and 1-alkoxy-2,2,6,6-tetramethylpiperidines, and (h) a compound of the group consisting of di(1,2,2,6,6-pentamethylpiperidin-4-yl)sebacate, 4-stearoyloxy-2,2,6,6-tetramethylpiperidine, di(,2,2,6,6-tetramethylpiperidin-4-yl)sebacate and bis (1-octyloxy-2,2,6,-tetramethyl-4-piperidyl)sebacate.

2. The novel molybdenum compound according to claim 1, wherein the diol is 2-ethyl-1,3-hexanediol or 1,2-dodecanediol.

3. The novel molybdenum compound according to claim 1, wherein the molybdenum source is one of a metal salt of molybdic acid, ammonium molybdate, and molybdenum trioxide.

4. A lubricating composition, comprising at least 50 wt % of a lubricating oil basestock and a molybdenum compound, the molybdenum compound being a reaction product of a hindered amine and a molybdenum source and one of the following:

(a) the reaction product of a fatty oil with a diethanolamine, and water, or (b) a diol, and water, wherein the diol is of the following formula:

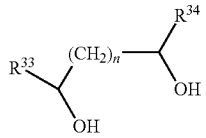

where n=0 to 12, and $R^{33}$ and $R^{34}$ is hydrogen or a hydrocarbon with between 1 and 25 carbon atoms, wherein the molybdenum compound is present in the lubricating composition in an amount which provides 1 to 2000 ppm molybdenum, and wherein the hindered amine is one or more chosen from the group consisting of:

(a) a compound of the formula

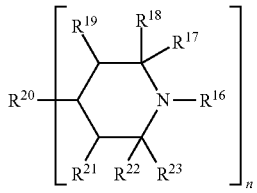

where $R^{16}$ is H, O or a hydrocarbon from 1 to 25 carbon atoms, an alkoxy radical with the oxygen bound to the nitrogen with the alkyl portion containing 1 to 25 carbon atoms, or a COR group, the R being a hydrocarbon containing from 1 to 25 carbon atoms, $R^{17}$, $R^{18}$, $R^{22}$, $R^{23}$ are hydrocarbons with 1 to 25 carbon atoms, $R^{19}$, $R^{21}$ are H or hydrocarbons with 1 to 25 carbon atoms, when n=1, $R^{20}$ is OH, H, O, $NH_2$, $NR_2$ where R is a hydrocarbon with 1 to 25 carbon atoms, an ester group $O_2CR$ where R is a hydrocarbon with 1 to 25 carbon atoms, or a succinimide group, when n=2, $R^{20}$ is the diacyl radical of an aliphatic dicarboxylic acid having 4 to 12 carbon atoms (b) 4-stearoyloxy-2,2,6,6-tetramethylpiperidin, (c) di(2,2,6,6-tetramethylpiperidin-4-yl)sebacate, (d) di(1,2,2,6,6-pentamethylpiperidin-4-yl)sebacate, (e) bis(1-octyloxy-2,2,6,-tetramethyl-4-piperidyl)sebacate (f) polymer-bound piperidine compound, (g) a compound of the group consisting of 2,2,6,6-tetramethylpiperidines, 1,2,2,6,6-pentamethylpiperidines, 1-oxo-2,2,6,6-tetramethylpiperidines, and 1-alkoxy-2,2,6,6-tetramethylpiperidines, and (h) a compound of the group consisting of di(1,2,2,6,6-pentamethylpiperidin-4-yl)sebacate, 4-stearoyloxy-2,2,6,6-tetramethylpiperidine, di(,2,2,6,6-tetramethylpiperidin-4-yl)sebacate and bis (1-octyloxy-2,2,6,-tetramethyl-4-piperidyl)sebacate.

5. The lubricating composition of claim 4, wherein the molybdenum compound is present in the lubricating composition in an amount which provides about 50 to 750 ppm molybdenum.

6. The lubricating composition of claim 5, wherein the molybdenum compound is present in the lubricating composition in an amount which provides about 125 to 750 ppm molybdenum.

7. The lubricating composition of claim 4, wherein the molybdenum compound is present in the lubricating composition in an amount which provides about 700 ppm molybdenum.

8. The lubricating composition of claim 4, further comprising a diaryl amine in an amount sufficient to provide about 0.001 to 2 wt % diarlyamine in the lubricating composition.

9. The lubricating composition of claim 4, wherein the diaryl amine in an amount sufficient to provide about 0.5 to 1.5 wt % diarlyamine in the lubricating composition.

10. A process for preparing a novel molybdenum compound, comprising the steps of combining in a reaction vessel (1) a molybdenum source, (2) a hindered amine, and one of (3) (i) a diol and water, and (ii) the reaction of product of a fatty oil and a diethanolamine, and water; heating the reactants to a temperature between 60 and 150° C. for a period of 1 to 6 hours; and removing the water, wherein the diol is of the following formula:

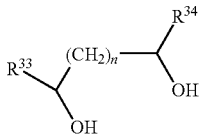

where n=0 to 12, and $R^{33}$ and $R^{34}$ is hydrogen or a hydrocarbon with between 1 and 25 carbon atoms, and wherein the hindered amine is one or more chosen from the group consisting of:

(a) a compound of the formula

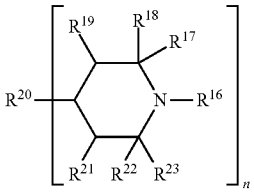

where $R^{16}$ is H, O or a hydrocarbon from 1 to 25 carbon atoms, an alkoxy radical with the oxygen bound to the nitrogen with the alkyl portion containing 1 to 25 carbon atoms, or a COR group, the R being a hydrocarbon containing from 1 to 25 carbon atoms, $R^{17}$, $R^{18}$, $R^{22}$, $R^{23}$ are hydrocarbons with 1 to 25 carbon atoms, $R^{19}$, $R^{21}$ are H or hydrocarbons with 1 to 25 carbon atoms, when n=1, $R^{20}$ is OH, H, O, $NH_2$, $NR_2$ where R is a hydrocarbon with 1 to 25 carbon atoms, an ester group $O_2CR$ where R is a hydrocarbon with 1 to 25 carbon atoms, or a succinimide group, when n=2, $R^{20}$ is the diacyl radical of an aliphatic dicarboxylic acid having 4 to 12 carbon atoms (b) 4-stearoyloxy-2,2,6,6-tetramethylpiperidine, (c) di(2,2,6,6-tetramethylpiperidin-4-yl)sebacate, (d) di(1,2,2,6,6-pentamethylpiperidin-4-yl)sebacate, (e) bis(1-octyloxy-2,2,6,-tetramethyl-4-piperidyl)sebacate (f) polymer-bound piperidine compound (g) a compound of the group consisting of 2,2,6,6-tetramethylpiperidines, 1,2,2,6,6-pentamethylpiperidines, 1-oxo-2,2,6,6-tetramethylpiperidines, and 1-alkoxy-2,2,6,6-tetramethylpiperidines, and (h) a compound of the group consisting of di(1,2,2,6,6-pentamethylpiperidin-4-yl)sebacate, 4-stearoyloxy-2,2,6,6-tetramethylpiperidine, di(,2,2,6,6-tetramethylpiperidin-4-yl)sebacate and bis (1-octyloxy-2,2,6,-tetramethyl-4-piperidyl)sebaca.

* * * * *